United States Patent [19]

Bru et al.

[11] 4,332,132

[45] Jun. 1, 1982

[54] FALSE-TWIST APPARATUS

[75] Inventors: Christian Bru, Renaison; Jean-Claude Dupeuble, Roanne, both of France

[73] Assignee: ASA S.A., France

[21] Appl. No.: 162,322

[22] Filed: Jun. 23, 1980

[30] Foreign Application Priority Data

Jun. 25, 1979 [FR] France ..... 79 17259

[51] Int. Cl.[3] ..... D02G 1/02

[52] U.S. Cl. ..... 57/280; 57/291

[58] Field of Search ..... 57/261, 279, 280, 284, 57/291, 352

[56] References Cited

U.S. PATENT DOCUMENTS

| | | | |
|---|---|---|---|
| 3,729,916 | 5/1973 | Lusk | 57/280 X |
| 3,903,682 | 9/1975 | Crouzet | 57/280 X |
| 3,916,609 | 11/1975 | Yamada | 57/291 |
| 3,971,201 | 7/1976 | Hartig | 57/352 X |
| 4,015,414 | 4/1977 | Sholly | 57/284 X |
| 4,051,650 | 10/1977 | Gleyze et al. | 57/291 |
| 4,058,961 | 11/1977 | Kubler | 57/291 |

FOREIGN PATENT DOCUMENTS 1197935 7/1970 United Kingdom .

*Primary Examiner*—Donald Watkins

*Attorney, Agent, or Firm*—Arnold, White & Durkee

[57] ABSTRACT

The invention concerns a false-twist texturizing machine of the type in which the heater, the cooling zone and the false-twist spindle are in substantially straight alignment and arranged at least in part above the service zone. The machine of the invention is characterized by the fact that the heating device, arranged upstream of the spindle at the upper part of the machine, is an open heater and that the machine includes means for lacing up and guiding the yarn between the first yarn feeder and the entry point of the heating device. Such means may comprise a mobile launching device on a fixed ramp extending itself from proximate the first yarn feeder to a point proximate the heater entry, the aforesaid launching device being associated with a yarn deflecting element whose purpose is to distribute the twist communicated by the spindle in such a way that, when launching, the majority of the twist backs up to the level of the first yarn feeder and that, during normal operation, a minor part of the twist backs up to the first yarn feeder, the majority of the twist remaining in the heater.

11 Claims, 7 Drawing Figures

FALSE-TWIST APPARATUS

BACKGROUND OF THE INVENTION

1. Field of the Invention

The present invention relates to an improved machine for the manufacture of texturized yarns by false-twist, and more particularly to a machine for processing of partially drawn or undrawn yarns either by the so-called "sequential draw-texturizing" technique or by the so-called "simultaneous draw-texturizing" technique.

2. Description of the Prior Art

Commonly assigned U.S. Pat. No. 4,051,650 describes a false-twist texturizing machine which presents reduced overall dimensions, particularly in height, and which, furthermore, provides a straight linear path for the yarn between the entry of the thermal treatment heater and the false-twist spindle.

Generally, the machine described in the aforesaid U.S. Pat. No. 4,051,650 includes a plurality of treatment positions, comprising in operational sequence:

a yarn supply device;
a first yarn feeder;
a heating device;
a cooling zone for the heated yarn;
a false-twist spindle; and
a wind-up device;

and, when desired, the machine may further include a thermal setting device with a third yarn feeder situated immediately before the wind-up device. The machine of U.S. Pat. No. 4,051,650 comprises a central frame on either side of which are arranged symmetrically the treatment positions. Between the yarn supply and the wind-up zone, this machine defines a service zone for the personnel, with the first heater, the cooling zone and the point where the yarn enters the false-twist spindle being in substantially straight alignment and arranged at least in part above the service zone.

Advantageously, the first heater and the cooling zone are inclined with respect to the horizontal plane, and means are provided to guide the yarn from the first yarn feeder to the entry of the first heater. With a closed heater, as illustrated in U.S. Pat. No. 4,051,650, the guide means may comprise a J-shaped tube whose point of entry is situated proximate the first yarn feeder and which is connected to the heater entry.

The machine of U.S. Pat. No. 4,051,650 has proved satisfactory in that it permits a substantially straight yarn threadline in the heater and cooling zone while having the advantages of minimum overall dimensions and of allowing the operator to have easy access to the essential parts of the machine, particularly during the lacing-up operations.

However, it has been noticed that for certain applications, particularly when processing fine yarn counts, for example with polyamide counts between 12 and 44 decitex, yarn irregularities may occur between the spindle and the first yarn feeder.

As described in U.S. Pat. No. 3,772,869, a texturizing machine could include at the entry point of the heater a device for locking the inserted twist; but this leads to yarn launching problems, and furthermore, during normal operation, breakages occur at the level of the transfer-tail knots.

The present invention defines an improvement in false-twist texturizing machines of the type described in the aforesaid U.S. Pat. No. 4,051,650, which overcomes the aforesaid disadvantages while keeping the advantages of the straight linear threadline, the low height, and service facility for the operator.

SUMMARY OF THE INVENTION

Generally, the texturizing machine of the present invention has a similar structure to the one described previously which is the subject of U.S. Pat. No. 4,051,650, wherein the heating device arranged upstream of the spindle at the upper part of the machine is an open heater. The machine of the present invention further includes means for launching and guiding the yarn between the first yarn feeder and the entry point of the heater. Such means may comprise a mobile launching device on a fixed ramp extending itself from proximate the first yarn feeder to a point proximate the heater entry, the aforesaid launching device being associated with a yarn deflecting element whose purpose is to distribute the twist communicated by the spindle in such a way that, when launching, the majority of the twist backs up to the level of the first yarn feeder and that, during normal operation, a minor part of the twist backs up to the first yarn feeder, the majority of the twist remaining in the heater.

Furthermore, in order to facilitate heater maintenance and cleaning, preferably the heater is pivotally mounted on a frame. To avoid two adjacent yarns from entangling themselves, for example, during a breakage, and to prevent undesirable yarn vibrations, a guide plate may also be provided between the first yarn feeder and the heater entry.

Advantageously, the fixed ramp on which the launching device moves, as well as the guide plate, are mounted on the same support as the heater and may pivot with the latter.

DETAILED DESCRIPTION OF THE INVENTION

In order that the invention and its advantages may be more fully understood, the following description is given, by way of example, reference being made to the accompanying drawings.

This example illustrates a texturizing machine consistent with the invention, comprising one single heater, but it is evident that this is not a limitation and, as described in the U.S. Pat. No. 4,051,650, it could be foreseen, in the machine central part between the second yarn feeder and wind-up, a second setting heater and a third yarn feeder situated immediately before the wind-up.

Figure 1:
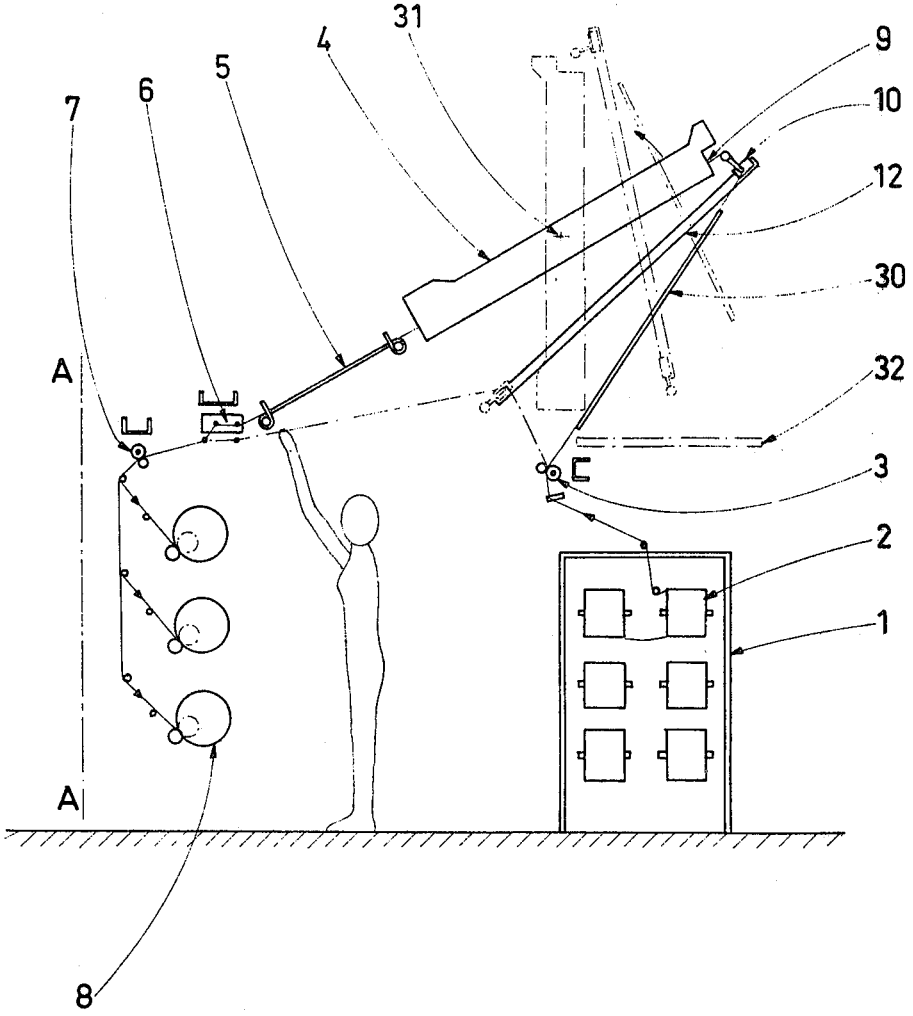
FIG. 1 is a schematic side elevation of the treatment positions of one embodiment of a machine constructed in accordance with the present invention.

As illustrated in FIG. 1, the false-twist texturizing machine according to the invention comprises, in a manner which is described in U.S. Pat. No. 4,051,650, a plurality of treatment positions arranged symmetrically with respect to the machine central axis A—A. Each position comprises:

- a creel 1 for supplying the yarn 2 to be processed;
- a first yarn feeder 3, for example, of the apron-type; capstan-type, or equivalent;
- a yarn heating device 4;
- a yarn cooling device 5;
- a false-twist spindle 6, preferably of the external friction type;
- a second yarn feeder which may, if desired, be similar to the first yarn feeder 3; and
- a wind-up device 8 for the processed yarn in the form of a bobbin.

The first heater 4 and the cooling zone 5 are in substantially straight alignment in such manner that the yarn 2 may have a practically linear thread line between its point of entry in the spindle 6 and the point of entry 9 to heater 4.

Since the yarn feeders, the heater, the cooling element and the spindles are well-known elements, they will not be described in detail herein.

In the illustrated embodiment, the inclination of the heater 4 and of the cooling zone 5 with respect to the horizontal portion is preferably approximately 45°, but it should be clearly understood that this is not a limitation.

According to the invention, means are provided for permitting the launching and guiding of the yarn between the first yarn feeder 3 and the point of entry 9 of the heater.

These means, of which a particular embodiment is illustrated in detail in FIGS. 2 and 3, may comprise a mobile launching device 10 on a fixed ramp 12, arranged below heater 4 and extending itself from proximate the first yarn feeder 3 to a point proximate the point of entry 9 of heater 4.

This launching device 10 is equipped with a yarn deflecting element which permits, during launching, the twist communicated by the spindle 6 to back up freely as far as yarn feeder 3, whereas, in normal operation, it distributes the aforesaid twist in such a way that a minor part backs up to the first yarn feeder 3, the remaining twist in heater 4 being maintained at a maximum constant level.

Figures 2, 7:
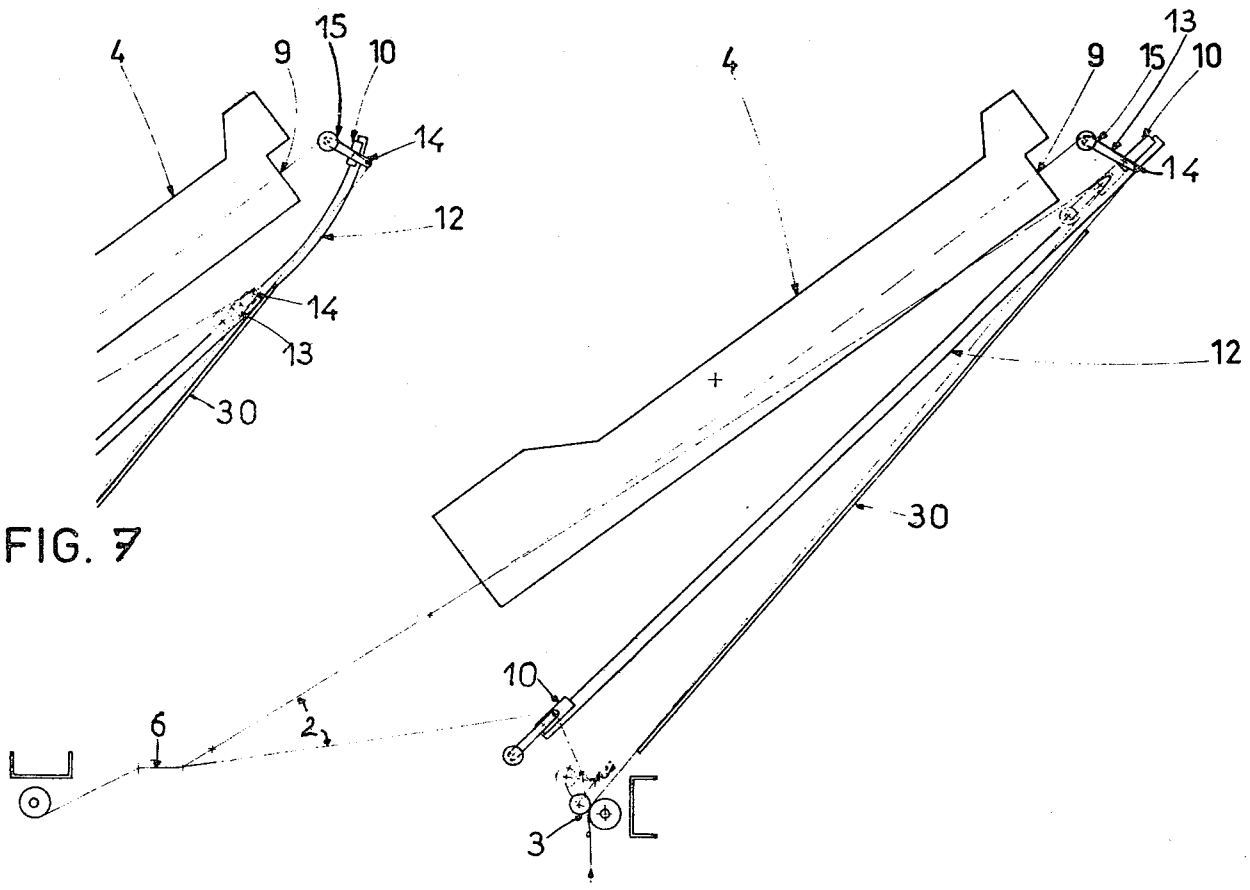
FIG. 2 is a more detailed view, in particular, showing the heater and launching means and yarn guides.
FIG. 7 is a detailed view of an alternative embodiment of the invention, illustrating the heater entry extremity and associated elements.
Figure 3:
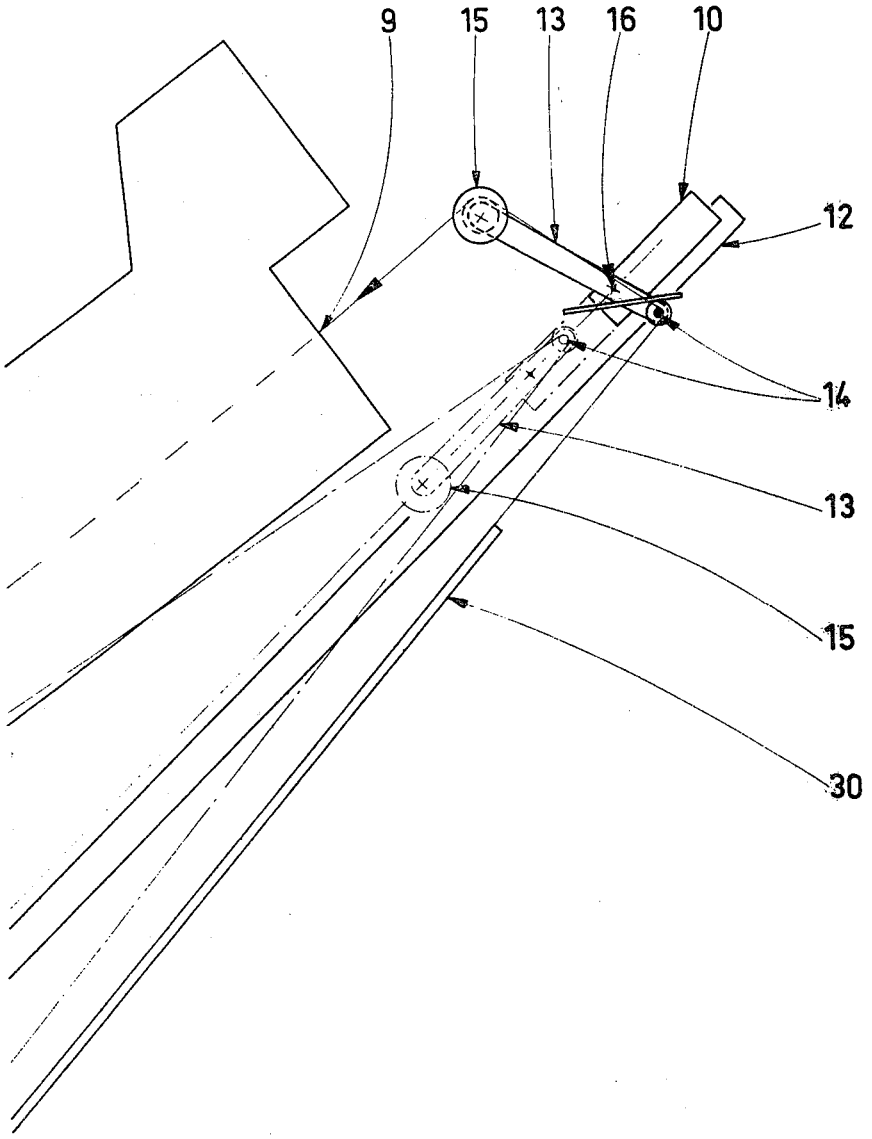
FIG. 3 is a partial enlarged view showing in detail an embodiment of a launching device associated with a distributing deflecting element, according to the invention, with the elements being shown, on one hand, in dashed lines, when launching, and on the other hand, in solid lines, during normal operation.

In the embodiment illustrated by FIGS. 2 and 3, the launching device 10 has the shape of a small carriage mounted for sliding on fixed ramp 12. The displacement means for this carriage 10 (not shown on the drawings) may take the form of any appropriate means, such as, for example, manual, electrical or pneumatic means.

In this embodiment, the yarn deflecting element comprises a retractable arm 13, pivotally mounted on carriage 10, which is equipped at one of its extremities with a deflecting guide 14, for example, a ceramic pin, and at its other end with a disc 15, for example, of the type described in U.S. Pat. Nos. 3,772,869 and 3,645,081, this disc being either fixed or rotatable, but preferably fixed.

When launching, as it is shown in detail by the dashed lines in FIG. 3, the arm 13 is kept parallel to ramp 12, and the yarn is only in contact with the yarn deflecting element 14, and when the launching device arrives at the extremity of ramp 12, putting the lacing-up device near the point of entry 9 of the heater, the arm 13 pivots around its axis 16, for example, by means of a stop. During this displacement, yarn 2 surrounds the disc 15 and comes into contact with the surface of heater 4.

FIG. 7 illustrates an alternative embodiment in which ramp 12 is not rectilinear throughout its length, but presents a curved portion at its extremity near the point of entry 9 of heater 4. In this way, as represented in FIG. 7 in dashed lines, when launching, the yarn only passes around the yarn deflecting element 14, which permits the twist to back up as far as yarn feeder 3 and, owing to the ramp 12 curved portion, arm 13 pivots automatically so that the yarn surrounds disc 15 and is brought into contact with the surface of heater 4.

Thus, when launching, it is possible to allow the twist communicated by the spindle 6, to back up freely as far as yarn feeder 3, which, in the case of non-drawn or partially drawn yarns, facilitates this operation and avoids breakages. Furthermore, in normal operation, the twist distributing element or disc 15 maintains the twist constant, at a maximum level inside the heater 4 while allowing a part of this twist to back up as far as yarn feeder 3. This allows, on the one hand, regular processing from one position to another, with the twist value on either side of the twist distributing element 15 being adjustable by modifying the yarn angle around the latter and, on the other hand, in cases where there are transfer-tail knots in the yarn, to avoid breakages owing to the fact that the non-drawn yarn exiting from yarn feeder 3 will be slightly twisted.

Figure 4:
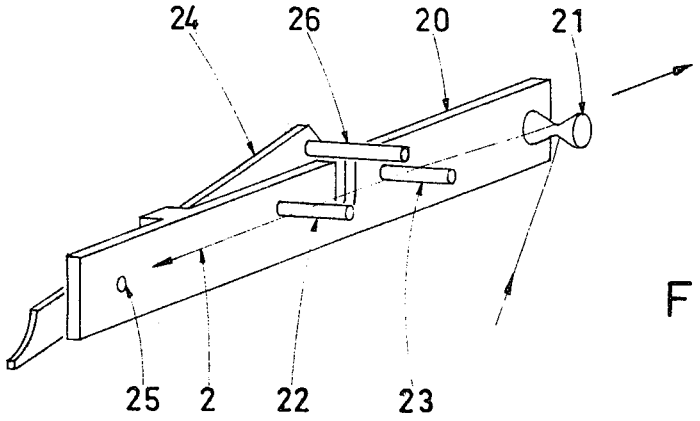
FIGS. 4 and 5 illustrate another type of launching device equipped with a twist distributing element, FIG. 4 depicting launching and FIG. 5 depicting normal operation.
Figure 5:
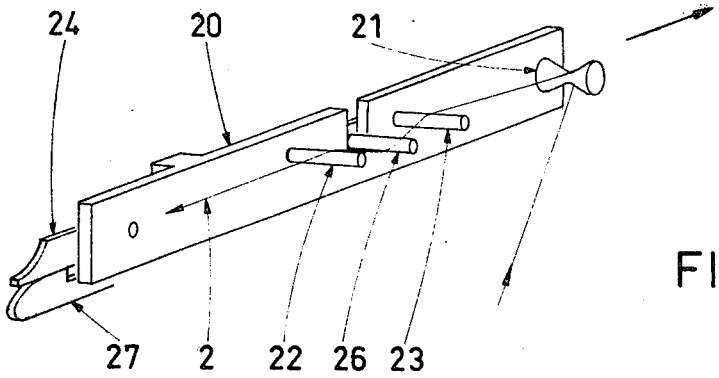

FIGS. 4 and 5 illustrate another type of yarn deflecting element available for carrying the invention into effect. In the embodiment shown in FIGS. 4 and 5, the carriage supporting the deflecting element, as well as the ramp 12, have not been shown for reasons of simplification. This deflecting element comprises a plate 20 supporting at one of its extremities a saddle-shaped guide 21 and in its central part two pins 22, 23. Furthermore, a second plate 24, articulated with respect to the first plate around an axle 25, and biased by a return spring (not shown), supports a third pin 26, which is maintained in a different plane with respect to the two other pins 22, 23. When launching (FIG. 4) the yarn 2 passes only around guide 21 and the twist can back up completely as far as yarn feeder 3, whereas, in normal operation, the action of ramp 27 provided at the extremity of ramp 12 causes the pivoting of plate 24 and, consequently, the displacement of pin 26 in order to deflect the yarn. Thus, it is possible to distribute the twist communicated by the spindle, on one hand, inside the heater 4 and, on the other hand, upstream of the deflecting element 21 to the first yarn feeder 3.

Locking means for element 10 are provided in the upper part of ramp 12 in order to immobilize it in normal operation and to release it when it is desired to carry out the lacing-up operation.

Furthermore, it is advantageous to provide between the first yarn feeder 3 and the point of entry 9 of the heater, below the ramp 12, a plate 30 against which yarn 2 is in contact during normal operation. This plate prevents the adjacent yarns from entangling themselves and prevents undesirable yarn vibration. Plate 30 may be a metallic plane plate, including a hollow track for guiding the yarn, or may be a simple tube against the periphery of which the yarn comes into contact, or other suitable means.

In the embodiment illustrated in FIG. 1, the heater 4, the ramp 12 and plate 30 are mounted on a common support (not shown) so that they may pivot around a common axis 31. Furthermore, a platform 32 is advantageously provided above the yarn supply zone 1. This greatly facilitates maintenance and cleaning of heater 4.

Furthermore, as represented in dashed lines in FIG. 1, it is desirable that heater 4 be made tiltable so that it may be positioned vertically to facilitate cleaning of plate 30 against which the yarn is in contact. The ramp 12 and the plate 20 are preferably mounted on the same support as heater 4 so that ramp 12 may pivot together with heater 4.

Figure 6:
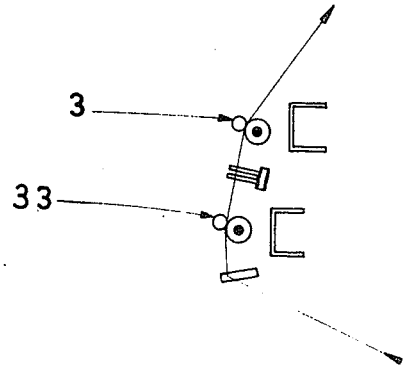
FIG. 6 is a schematic detailed view showing the adaptation of a machine according to FIG. 1 for draw-texturizing a yarn according to the so-called "sequential draw-texturizing" technique.

The machine of the present invention may be used either for draw-texturizing by the so-called "simultaneous method," that is to say by drawing the yarn in the zone located in between the yarn feeder 3 and spindle 6, or, as represented schematically in FIG. 6, by draw-texturizing the yarn according to the "sequential" technique. In this case, it is necessary to provide, as it is illustrated in FIG. 6, a second yarn feeder 33, the drawing being carried out in the zone between both yarn feeders 3 and 33, with conventional draw pins arranged between the yarn feeders.

EXAMPLE

On a false-twist texturizing machine such as illustrated in FIG. 1 and equipped with a yarn guide and launching device between the first yarn feeder 3 and the point of entry 9 of heater 4, is processed a partially drawn polyamide 66 yarn, presenting a count of 22 decitex after drawing and having 7 filaments.

The launching and guide device utilized is of the type illustrated in FIGS. 4 and 5. The device comprises a ceramic deflecting element 21, of 6 millimeters in diameter, and three pins of 4 millimeters, and acts, during normal operation, as a twist distributing element.

The processing conditions are the following:

supply speed: 680 meters per minute, second delivery speed of yarn feeder 7: 900 meters per minute, yarn heater 4: open heater of two meters length brought to a temperature of 235° C., wind-up speed in wind-up device 8: 792 meters per minute, false twist spindle 6: external friction spindle comprising ceramic discs, rotating at a speed of 13,800 revolutions per minute.

When launching, the yarn passes only around the launching saddle-shaped guide 21, the twist backing up as far as yarn feeder 3.

During normal operation, the yarn is submitted to an angle between pins 22, 26, 23, the twist communicated by the spindle 6 being distributed, inside heater 4 where it is maintained at a maximum constant level between the twist distributing element and the first yarn feeder 3. This twist is of 5800 turns per meter at the spindle level, of approximately 2900 turns per meter at the point of entry 9 of heater 4 and 200 turns per meter backing up as far as the level of yarn feeder 3.

By proceeding in this manner, a yarn is obtained which has the following characteristics:

| | | |
|---|---|---|
| CRIMP | EK : 65 | Characteristics determined |
| INTERMEDIARY CRIMP | KK : 52 | according to norm din 53840 |
| CRIMP STABILITY | : 99 | |
| HATRA CRIMP RIGIDITY | : 58.5 | |

In normal operation, it has been established that there has been no breakage during the passage of the transfer knots and the launching operation is accomplished satisfactorily.

As a comparison, an identical yarn was processed under the same conditions, except that the yarn passage through the twist distributor constituted by pins 22, 26 and 23 was deleted, the yarn only passing through the saddle shaped guide 21.

The yarn launching operation is carried out in a very satisfactory manner, but the resulting yarn is less regular from position to position and presents the following characteristics:

| | | |
|---|---|---|
| CRIMP | EK : 64 | Characteristics determined according to norm din 53840 |
| INTERMEDIARY CRIMP | KK : 50 | |
| CRIMP STABILITY | : 98.5 | |
| HATRA CRIMP RIGIDITY | : 55 | |

The invention is not limited to the illustrated embodiments, but it covers all variants realized with the same mind. For example, supply 1 could be placed, not on the floor as illustrated in FIG. 1, but above the machine on the platform 32, or even on another platform.

Furthermore, the twist distributing element could take a form other than that described herein, when launching, the twist can back up freely from the spindle to the first yarn feeder, whereas during normal operation it is distributed, on one hand, inside the heater and, on the other hand, to the first yarn feeder.

Compared to machines of the prior art, the texturizing machine of the instant invention permits, on one hand, the advantages of the machines described in commonly assigned U.S. Pat. No. 4,051,650 and, on the other hand, allows, more particularly in the case of processing fine polyamide yarns, the obtaining of a very good yarn regularity position to position, while permitting an easy access by the operator to the essential parts of the machine.

What is claimed is:

1. A yarn texturizing machine comprising a plurality of treatment positions, each said position comprising, in operational sequence:

a supply (1) for the yarn (2) to be processed;

a first yarn feeder (3);

a heating device (4);

a cooling zone (5) for the heated yarn;

a false-twist spindle (6);

a second yarn feeder (7);

a wind-up device (8);

said machine defining a central frame on either side of which are arranged symmetrically the treatment positions and defining between the yarn supply and the wind-up device, a service zone for the personnel;

the heating device (4), the cooling zone (5) and the point where the yarn enters the false-twist spindle (6) being in substantially straight alignment and arranged at least in part above the service zone; and the heating device (4) being situated upstream of spindle (6) in the machine upper part and being an open heater;

said machine further including means for launching and guiding the yarn between the first yarn feeder (3) to the point of entry (9) of the heating device (4), said means for launching and guiding comprising a mobile lacing-up device (10) on a fixed ramp (12) extending from a point proximate the point of entry (9) of the heater (4); said launching device (10) being associated with a yarn deflecting element whose purpose is to distribute the twist communicated by the spindle in such a way that, when launching, the majority of the twist backs up to the level of the first yarn feeder (3) and that, during normal operation, a minor part of the twist backs up to the first yarn feeder (3), the majority of the twist remaining in the heating device (4).

2. A texturizing machine as claimed in claim 1, wherein the heating device (4) is pivotally mounted on a frame and a guide plate (30) for the yarn is provided between the first yarn feeder (3) and the point of entry (9) of the heating device (4).

3. A texturizing machine as claimed in one of claims 1 and 2, wherein the deflecting element for the yarn (2) fitted on the launching device (10) comprises a retractable arm (13) pivotally mounted on device (10) and which is equipped at one of its extremities with a deflecting guide (14) and at its other extremity with a disc (15).

4. A texturizing machine as claimed in one of the claims 1 and 2, wherein the deflecting element comprises a plate (20) supporting at one of its extremities a saddle-shaped guide (21) and in its central part two pins (22) and (23), a second plate (24), articulated with respect to the first plate around an axle (25) and biased by a return spring, said second plate supporting a third pin (26) forming a deflection in conjunction with the two former pins (22), (23) during machine normal operation.

5. A texturizing machine as claimed in one of claims 1 and 2, wherein the heater (4), the ramp (12) for the mobile launching device, and the plate (30) are pivotally mounted on a common support.

6. A texturizing machine as claimed in claim 3, wherein the heater (4), the ramp (12) for the mobile launching device, and the plate (30) are pivotally mounted on a common support.

7. A texturizing machine as claimed in claim 4, wherein the heater (4), the ramp (12) for the mobile launching device, and the plate (30) are pivotally mounted on a common support.

8. In a yarn texturizing machine having, in operational sequence, a yarn supply, a first yarn feeder, a heating device, a cooling zone, a false-twist spindle, a second yarn feeder and a wind-up device, and wherein the heating device, the cooling zone and the entry point of the false-twist spindle are in substantially straight alignment, the IMPROVEMENT comprising:

means for launching and guiding the yarn between the first yarn feeder and the point of entry of the yarn into the heating device, said means including a yarn deflecting element selectively movable into and out of contact with the yarn, said yarn deflecting element when not in contact with the yarn serving to back up the twist to the first yarn feeder during launching, and said yarn deflecting element when in contact with the yarn serving to allow the majority of the twist to remain in the heating device during normal operation whereas a minor part of the twists back up to the first yarn feeder.

9. A texturizing machine as claimed in claim 8, wherein said yarn deflecting element comprises a disc mounted by a movable support.

10. A texturizing machine as claimed in claim 8, wherein said yarn deflecting element comprises a pair of fixed elements over which the yarn passes without contact during launching, said yarn deflecting element further comprising a third element movable between said pair of fixed elements to bring the yarn into contact with all three elements during normal operation.

11. A yarn texturizing machine comprising a plurality of treatment positions, each said position comprising a substantially T-shaped framework, said machine having a vertical portion and a horizontal portion and, in operational sequence, a yarn supply device, a first yarn feeder, a yarn heating device, a cooling zone for the heated yarn, a false-twist spindle, a second yarn feeder and a wind-up device, the heating device and the cooling zone being on the horizontal portion, said T-shaped framework defining a service zone facilitating easy access to the machine parts by the operator, and means for launching and guiding the yarn between the first yarn feeder and the point of entry of the yarn into the heating device, said means including a yarn deflecting element selectively movable into and out of contact with the yarn, said yarn deflecting element when not in contact with the yarn serving to back up the twist to the first yarn feeder during launching, and said yarn deflecting element when in contact with the yarn serving to allow the majority of the twist to remain in the heating device during normal operation whereas a minor part of the twist backs up to the first yarn feeder.

* * * * *

UNITED STATES PATENT AND TRADEMARK OFFICE

CERTIFICATE OF CORRECTION

PATENT NO. : 4,332,132

DATED : June 1, 1982

INVENTOR(S) : Christian Bru & Jean-Claude Dupeuble

It is certified that error appears in the above—identified patent and that said Letters Patent is hereby corrected as shown below:

Column 1, line 62, please cancel "locking" and insert --arresting--.

Column 4, line 7, please cancel "lacing-up" and insert --launching--.

Column 7, line 11, please cancel "lacing-up" and insert --launching--.

Signed and Sealed this

*Nineteenth* Day of *April 1983*

[SEAL]

*Attest:*

GERALD J. MOSSINGHOFF

*Attesting Officer*

*Commissioner of Patents and Trademarks*